US005332008A

United States Patent [19]

Todd et al.

[11] Patent Number: 5,332,008

[45] Date of Patent: Jul. 26, 1994

[54] GASOLINE DISPENSER WITH ENHANCED VAPOR RECOVERY SYSTEM

[75] Inventors: John A. Todd; William H. Constantine, both of Salisbury, Md.

[73] Assignee: Dresser Industries, Inc., Dallas, Tex.

[21] Appl. No.: 13,582

[22] Filed: Feb. 4, 1993

[51] Int. Cl.[5] ..... B65B 3/18

[52] U.S. Cl. ..... 141/5; 141/83; 141/59; 141/44; 141/198; 220/86.1; 137/587

[58] Field of Search ..... 141/44–46, 141/59, 301, 302, 198, 83, 1, 5; 220/86.1, 86.2, 89.2; 137/587–589

[56] References Cited

U.S. PATENT DOCUMENTS

| | | | |
|---|---|---|---|
| 3,826,291 | 7/1974 | Steffens | 141/59 |
| 3,881,894 | 5/1975 | Onufer | 55/88 |
| 3,913,633 | 10/1975 | Hiller | 141/45 |
| 4,047,548 | 9/1977 | Wagner | 141/59 |
| 4,056,131 | 11/1977 | Healy | 141/206 |
| 4,057,086 | 11/1977 | Healy | 141/206 |
| 4,058,147 | 11/1977 | Stary et al. | 141/58 |
| 4,068,687 | 1/1978 | Long | 141/59 |
| 4,095,626 | 1/1978 | Healy | 141/59 |
| 4,167,958 | 9/1979 | Voelz | 141/59 |
| 4,197,883 | 4/1980 | Mayer | 141/59 |
| 4,199,012 | 4/1980 | Lasater | 141/52 |
| 4,202,385 | 5/1980 | Voelz et al. | 141/59 |
| 4,253,503 | 3/1981 | Gunn | 141/59 |
| 4,260,000 | 4/1981 | McGahay et al. | 141/59 |
| 4,295,505 | 10/1981 | Hasselmann et al. | 141/59 |
| 4,310,033 | 1/1982 | Deters | 141/59 |
| 4,336,830 | 6/1982 | Healy | 141/59 |
| 4,429,725 | 2/1984 | Walker et al. | 141/59 |
| 4,687,033 | 8/1987 | Furrow et al. | 141/59 |
| 5,038,838 | 8/1991 | Bergamini et al. | 141/59 |
| 5,040,577 | 8/1991 | Pope | 141/59 |
| 5,156,199 | 10/1992 | Hartsell, Jr. et al. | 141/83 |
| 5,172,738 | 12/1992 | Komukai et al. | 141/83 |
| 5,195,564 | 3/1993 | Spalding | 141/1 |
| 5,197,523 | 3/1993 | Fink, Jr. et al. | 141/206 |

*Primary Examiner*—Ernest G. Cusick
*Attorney, Agent, or Firm*—Hubbard, Tucker & Harris

[57] ABSTRACT

A service station dispenser for gasoline with a vapor collection system is disclosed which processes the electrical signal typically produced by the fuel meter which represents the volume flow rate of fuel to the tank to control the displacement volume of an electrically driven vacuum pump so that a simple vacuum intake disposed preferably inside, but not sealed with, the filler neck can be used to collect only the vapors displaced from the fuel tank by the fuel. The vacuum pump is controlled by a digital processor which prestarts the vacuum pump after a customer demands dispensing to establish a vacuum at the vacuum intake is established by the time fueling is allowed to take place so as have an immediate vacuum available to assist recovery of an initial rush of vapor displaced by commencement of fueling. Once fuel flow starts, the digital processor operates the vacuum pump to produce a vapor flow rate having a proportional relationship with the flow rate of the fuel.

20 Claims, 2 Drawing Sheets

GASOLINE DISPENSER WITH ENHANCED VAPOR RECOVERY SYSTEM

FIELD OF THE INVENTION

This invention relates generally to volatile liquid dispensing systems of the type used to dispense gasoline into automotive fuel tanks, and more particularly relates to such a dispensing system which includes a vapor collecting system.

BACKGROUND OF THE INVENTION

As an automobile is being refueled with gasoline at a service station, each gallon of gasoline flowing into the fuel tank displaces approximately three hundred cubic inches of gasoline vapor which, unless collected, escapes into the atmosphere. Such vapors not only contribute to atmospheric pollution, but also are unpleasant to the person operating the nozzle, and may adversely affect the person's health over a longer term. As a result, some governmental authorities require that these vapors be collected. Various systems have been proposed and used for collecting and returning these vapors to a storage vessel, typically the underground storage tank from which the gasoline is being dispensed. The vapors thus stored are then collected for subsequent disposal by the over-the-road tanker when it delivers additional fuel to the storage tank.

In one such system, the dispensing pump nozzle is sealed to the filler pipe of the fuel tank so that the displaced vapor is directed by way of an annular conduit around the nozzle and coaxial dual conduit hose and appropriate plumbing to the underground storage tango. The design of the nozzle necessary to effect a seal has generally involved the addition of a bellows around the spout to seal the annular vapor passageway to the filler neck of the tank, as well as various other modifications which make the hand-held nozzle heavy and cumbersome, thereby causing the fueling process to be quite difficult and onerous, particularly for the self-serve motorist.

The problems relating to the design of the nozzle has been mitigated to a large extent by a system which utilizes a vacuum pump to assist the collection of vapor and transfer it to the storage tank. As a result of the use of the vacuum pump, it is unnecessary to seal the vapor line to the filler neck of the tank by the bellows, hence reducing the weight of the nozzle and simplifying the fueling process. In this type system, the vacuum inlet for the vapors need only be placed in close proximity to the filler neck of the tank. However, it is very important in this system that the rate of gaseous mixtures drawn in through the vacuum inlet closely approximate the volume of vapor being displaced by the gasoline flowing into the tank. If the volume of vapor being collected is less than that flowed from the tank, it will obviously result in some vapor escaping into the atmosphere. On the other hand, if a volume greater than the displaced vapors is collected, either air may be drawn in with the vapors, which can create a hazardous vapor/air mixture in the storage tank, or a portion of the gasoline dispensed into the tank will be vaporized to make up the difference between the volumetric displacement of the vacuum pump and the vapor displaced by the gasoline added to the fuel tank.

Several systems have been previously developed which utilized this system to achieve control of the appropriate ratio of vapor to liquid dispensed. In one such system, described generally in U.S. Pat. No. 4,202,385, a positive displacement vacuum pump is driven with a hydraulic motor, which in turn is driven by the flow of gasoline being dispensed to the tank. In another type system, a jet pump is driven by one of the submersible pumping units, for example, the regular grade, of the service station to generate a vacuum in a common vapor manifold.

SUMMARY OF THE INVENTION

The primary objective of the invention is to enhance the efficiency of a vacuum-assisted vapor recovery system, particularly of the type in which a rate at which a vacuum pump draws in vapor is in some way dependent on the fuel flow rate. Efficiency of vapor recovery is harmed by a delay associated with establishing a vacuum in a vapor collection system once fuel begins to flow. This delay results in the initial rush of fuel into the tank displacing vapor into the atmosphere before the vapor collection system becomes effective. Furthermore, establishing a vacuum at a vapor collection point near the filling neck of a vehicle is slowed whenever a liquid has collected in the vapor collection hose, as is usually the case when an annulus formed by an outer hose of a coaxial hose is used for vapor return and the center hose used for fuel.

The invention overcomes these problems by starting a vapor vacuum pump, driven by an electric motor, to establish a vacuum in the collection system between the vacuum pump and a vapor valve which is disposed between the vacuum pump and the vapor intake, prior to enabling commencement of fueling. This prestarting of the vacuum ensures that the vapor collection system is operative almost instantly when the customer opens the fuel valve to initiate fuel delivery, making it capable of drawing in the initial rush of vapor into the vapor hose and past or through any liquid trapped in the vapor hose. To further improve recovery, the vacuum valve is preferably in a hand-held unit including the fuel valve and the nozzle. Once a flow of fuel actually commences, the vacuum pump is operated at a rate having a predetermined relationship to the flow rate of the liquid. The prestart vacuum further enables the vacuum pump to more quickly establish the appropriate vapor flow rate. The efficiency of the vapor recovery system is thus substantially improved.

In accordance with another aspect of the invention, the vacuum pump is started and establishes the slight vacuum during a reset cycle of an electronic display unit at the point of dispensing. Introduction of an additional delay between the time a customer demands fueling and the time fuel is pressurized at the nozzle for dispensing is thereby avoided.

In accordance with another aspect of the invention, the vacuum pump is operated at a rate to establish a slight vacuum when fuel flow stops during a dispensing cycle and then returned to proportional flow once fuel flow resumes.

BRIEF DESCRIPTION OF THE DRAWINGS

These and other objects, features and advantages of the invention will be apparent to those skilled in the art from the following description of the preferred embodiment taken together with the accompanied drawings in which.

DESCRIPTION OF A PREFERRED EMBODIMENT OF THE INVENTION

Figure 1:
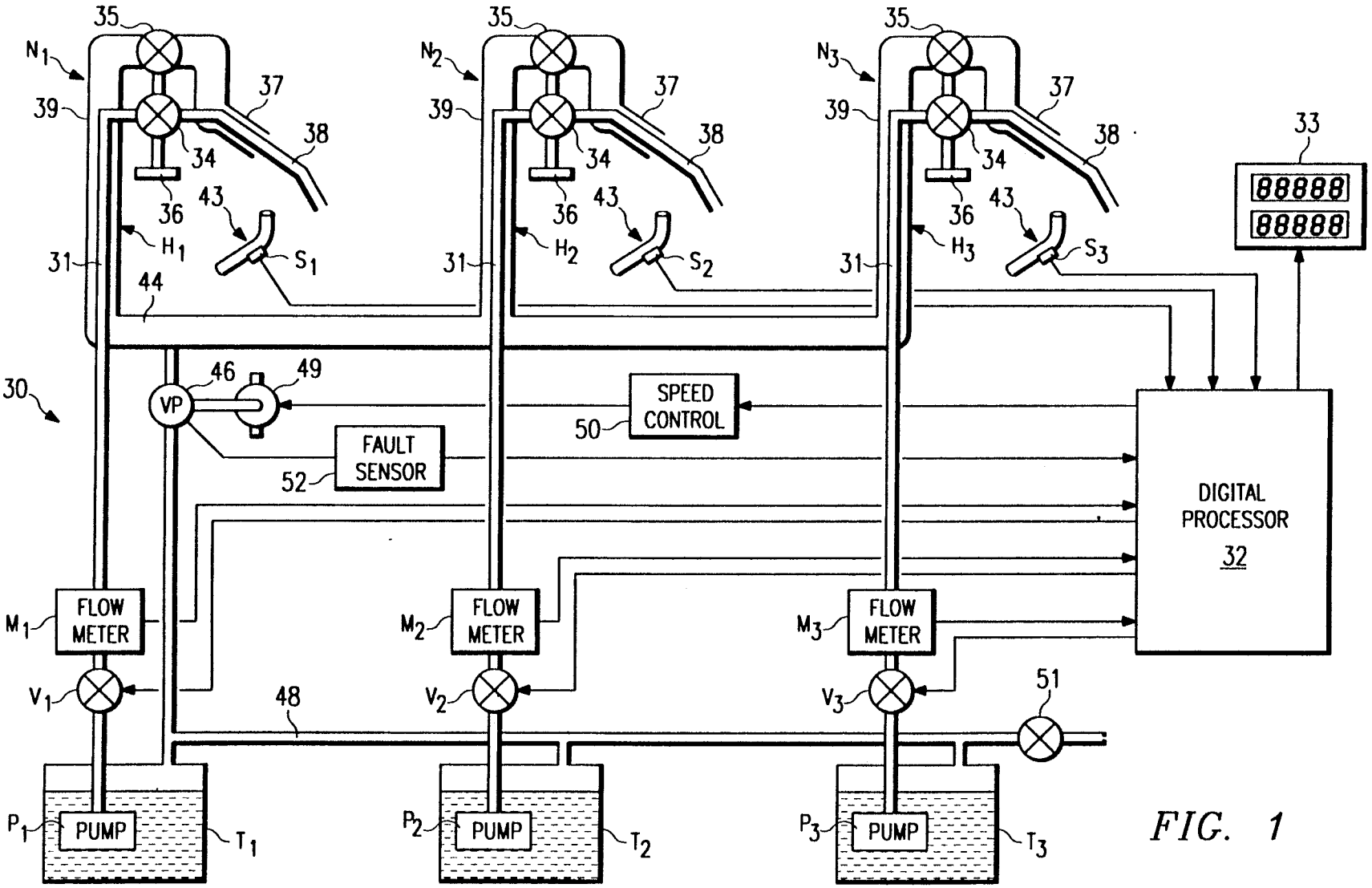
FIG. 1 is a schematic diagram which serves to illustrate a preferred embodiment of a liquid dispensing system in accordance with the present invention.

The invention will be described with reference to a liquid fuel dispensing system indicated generally by the reference numeral 30 in FIG. 1. The liquid fuel dispensing system 30 is generally of the type of liquid dispensing system shown in FIGS. 2, 3 and 4 of U.S. patent application, Ser. No. 07/693,549, filed Apr. 30, 1991, now U.S. Pat. No. 5,195,564, issued Mar. 23, 1993, which application is incorporated herein by reference.

The system 30 illustrates a single-point dispensing system for three different grades of fuel stored in tanks $T_1$, $T_2$ and $T_3$. A submersed pump $P_1$ delivers fuel from the tank $T_1$ through an electrically controlled, preferably two-stage control valve $V_1$, a flow meter $M_1$ and one conduit 31 of a dual-line flexible hose $H_1$ to a hand-held nozzle unit $N_1$. The nozzle $N_1$ is normally placed on the hanger switch $S_1$ in the conventional manner. Similarly, fuel is delivered from tank $T_2$ by pump $P_2$ through control valve $V_2$, flow meter $M_2$ and the fuel line 31 of dual conduit hose $H_2$ to nozzle $N_2$, which is normally stored on switch 52, and fuel is delivered from tank $T_3$ by pump $P_3$, through control valve $V_2$, flow meter $M_3$, dual conduit hose $H_3$ and hand-held nozzle $N_3$, which is associated with switch $S_3$.

Each of the flow meters, $M_1$, $M_2$ and $M_3$, produce an electrical signal indicative of the volume of liquid flowing through the meter to the respective nozzles, which signal is fed to a digital processor 32. The digital processor continually integrates the flow rate information to calculate the total volume and cost of the fuel as it is being dispensed through the meter activated by the customer's use of the respective on-demand nozzle. This information is typically shown to the customer on an electronic display D at the point of sale, and may also be displayed to the cashier in a self-service operation. The digital processor is connected to control valves $V_1$, $V_2$ and $V_3$ and receives input signals from switches $S_1$, $S_2$ and $S_3$ for purposes which will presently be described.

Each of the nozzles, $N_1$, $N_2$ and $N_3$, includes a fueling valve 34 and a vacuum valve 35. Fueling valve 34 is manually actuated by a customer pulling on lever 36. The vacuum valve is spring loaded to open when pulled on by a vacuum of 5" HG. Alternately, the vacuum valve may be manually opened with lever 36, in order to be able to pull a greater vacuum, or it may be opened by a flow of fuel through the nozzle. A vacuum intake 37 is disposed adjacent a fuel outlet nozzle 38 so as to be partially within the filler neck of the tank, or in such other manner as to effectively capture the vapors displaced from the fuel tank as the gasoline flows into the tank. Generally, the vapor intake circumscribes nozzle 38 and just fits within the opening of a filler neck of a vehicle's tank. When vacuum valve 35 is opened, the vacuum intake is opened to the vacuum return line 39 of the respective hose, $H_1$, $H_2$ or $H_3$, and thence to a common vacuum header 44, which in turn is connected to the intake of a positive displacement vacuum pump 46, which is preferably a conventional type pump. The output of the vacuum pump is connected to a vacuum header 48 interconnecting the fuel storage tanks $T_1$, $T_2$ and $T_3$. The header 48, and therefore the tanks $T_1$, $T_2$ and $T_3$, are vented to atmosphere by a pressure relief valve 51 of conventional design. Valve 51 releases pressure or vacuum in the tank that might otherwise cause the underground tanks to deform and possibly begin to leak fluid or vapor.

The vacuum pump 46 is driven by a variable speed electric motor 49. Electrical power for the motor and other electrical components are not illustrated for simplicity. The speed of the motor 49 is controlled by a suitable speed control circuit 50 which, in turn, is controlled by an output from the digital processor 32. A fault sensor 52 detects a failure of operation of the vacuum pump and provides an appropriate signal to the digital processor 32 to exit the dispense cycle and thus disable the system from dispensing fuel in the event that the vacuum pump fails or does not operate at the correct speed. The digital processor 32 can be a dedicated microprocessor, but in a preferred embodiment of the invention, is the processor which also operates the total service station system and includes the calculation of the volume being delivered to the customer and the cost, which information is displayed at the point of sale by display 33.

A typical delivery rate of fuel through a selected nozzle is about ten gallons per minute, thus requiring about three thousand cubic inches per minute displacement for the vacuum pump at a maximum speed of about 1,500 rpm. Such a pump typically requires a two-amp, 120 volt, 50/60 cycle electric motor with a speed range from zero to 1,500 rpm. Such a pump and motor can be manufactured at a relatively low cost. The speed control 50 is of conventional design, and is responsive to an appropriate signal produced by the digital processor 32 in response to the signal from the active flow meter $M_1$, $M_2$ or $M_3$, which typically provides pulses at a rate corresponding to the flow rate through the meter. The rate of these pulses can easily be translated into the appropriate signal to synchronize the pumping rate of the vacuum pump with the flow rate of the gasoline through the meter and maintain a predetermined ratio of liquid and vapor flow rates, preferably vapor/liquid flow rate ratio of approximately 1.18 to 1.0. This ratio is suitable for providing recovery of a vapor flow rate expected from a vehicle's tank during fueling under normal operating conditions. The proportion of flow rates may be varied according to one or more of the following factors: the vapor flow rate: ambient temperature; fluid temperature; vapor temperature; pressure or vacuum in the fill pipe or tank of the vehicle; or the pressure or vacuum in the vapor return lines or manifold or in the storage tanks T.

The digital processor 32 is programmed using known techniques to operate the system 30 to dispense fuel on command from the customer into an automobile fuel tank. The system 30 will normally include a plurality of point of sale units each including the three nozzles $N_1$, $N_2$ and $N_3$ all connected to receive fluid under pressure from the submersed pumps $P_1$, $P_2$ and $P_3$ and connected back to the common manifold 48. The digital processor 32 will in that circumstance control the point of sale units. Thus, if any nozzle is active to pump from one of the tanks $T_1$, $T_2$ or $T_3$, the respective pump, $P_1$, $P_2$ or $P_3$ will be activated by the digital processor to maintain fuel at a predetermined pressure at the control valves $V_1$, $V_2$ and $V_3$. In the operation of the system 30 of FIG. 2, the pumps $P_1$, $P_2$ and $P_3$ provide liquid fuel under pressure to the respective nozzles $N_1$, $N_2$ and $N_3$.

Figure 2:
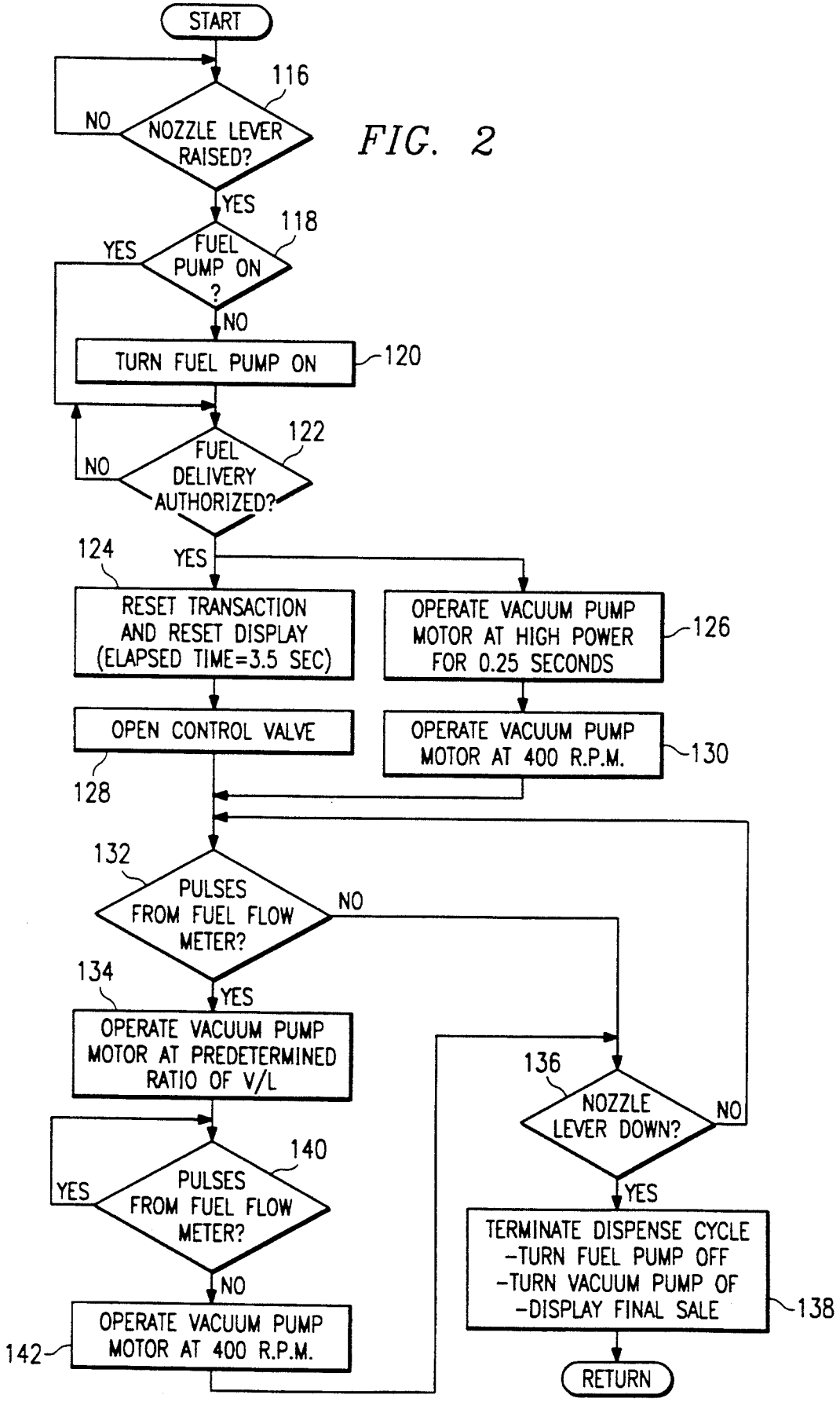
FIG. 2 is a flow diagram of a dispense cycle process for the liquid dispensing system of FIG. 1.

Please now refer also to FIG. 2. FIG. 2 is a flow diagram illustrating process steps of a dispense cycle process of the digital processor 32 that includes a prestarting of the vacuum pump. Prestarting the vacuum pump to establish a partial vacuum in the vapor recovery hoses prior to commencement of fueling ensures immediate presence of a vacuum at vapor intake 37 to draw in vapor displaced by an initial rush of fuel into the fuel tank. Without prestarting, an appreciable amount of vapor is lost before a sufficient vacuum is established at the vapor intake, especially when liquid has been previously drawn into the vapor hose 39 and trapped, blocking the hose at least partially and slowing vacuum formation at the vacuum valve 35.

To start the dispense cycle, a customer selects, typically, one of three grades of gasoline by removing the nozzle, for example nozzle $N_1$, corresponding to that grade from its resting cradle and raising the corresponding lever 43 to activate the corresponding switch $S_1$. The processor, at decision step 116 waits for the customer to raise lever 43. Once it is raised, the processor proceeds to decision step 118 and, if the fuel pump $P_1$ is not already on, turns on the fuel pump at step 120. Otherwise, it proceeds directly to decision step 122. At decision step 122, the processor determines if delivery of fuel has been authorized and, if not, waits to receive such authorization or for the occurrence of conditions under which fueling is authorized. Authorization however is not necessary and may not be required is some dispensing systems. Authorization may come from an attendant, usually after a customer prepays with cash or debit or credit card, or from a self-payment device located near the nozzles for accepting debit and credit cards directly from a customer.

Once fuel delivery is authorized, the processor begins a reset cycle at step 124 during which the accumulators or counters that track total volume of fuel and cost for each transaction are set to zero. In accordance with standards set by the National Conference on Weights and Measures in their Handbook 44, the processor then tests display 33 by exhibiting the character "8" at all character positions to verify operation of the display, followed by blanking out all positions to verify to the customer that the digital processor has reset the volume and cost counters to zero and that all display elements function. This resetting cycle takes approximately 3.5 seconds.

During the reset cycle, the processor directs the vapor recovery system to establish a partial vacuum at vacuum valve 34. The processor directs speed controller 50 to ramp up and to stabilize the speed of the vacuum pump motor as quickly as possible at a relatively low rate in order to establish the partial vacuum within the period of the reset cycle. The processor executes step 126 by signalling to the speed controller 50 to jolt the motor 49 of the vacuum pump 46 at 50% to 100% of maximum rated power for approximately 0.25 seconds. This brief burst of power to the vacuum pump motor assists the vacuum pump to begin rotating as quickly as possible. After expiration of 0.25 seconds, the processor executes step 130 with appropriate signals to the speed controller 50 to regulate the speed of the vacuum pump to a low rate, which is approximately 400 rpm, and maintains that speed. Running the vacuum pump at this speed establishes a partial vacuum of approximately 3.5" to 4.0" HG in vacuum hoses 39 and vacuum manifold 44 within approximately 3.5 seconds. The level of this partial vacuum is less than a closing bias on vacuum valve 35 that allows the vacuum valve to open without fuel flowing when subjected to a vacuum level greater than the bias, for example 5" HG. To avoid prematurely opening the vacuum valves, the partial vacuum created during step 130 is kept less than this preset vacuum level but great enough to provide adequate vacuum to quickly open the valve when fuel flow commences through the valve and begins to draw an initial flow of vapor immediately after commencement of a flow of liquid. If the vacuum valve is manually opened or opened by a flow of fuel, the prestart vacuum may be increased to a level that the closed vacuum valve can withstand. However, if the vacuum is too high, there is the undesirable possibility that air can be initially pulled into the vacuum recovery system. It is generally desirable for the prestart vacuum level to be relatively close to the normal operating vacuum to minimize the time to stabilize the vacuum after fuel flow commences.

After the reset cycle is completed, the processor executes step 128 by opening the respective control valve V. The prestart vacuum at the nozzle N has been established at this point by assuring that the vacuum pump has been operated to achieve, under worst case conditions, the vacuum with the prescribed period of the reset cycle. If the reset cycle is not existent or does not provide sufficient time, a delay step in the processor to establish the prestart vacuum will have to be introduced prior to step 128. Alternately, a vacuum level sensor may be included in the vapor recovery system and read by the processor just prior to step 128 to determine if the appropriate level has been reached. However, a vacuum level sensor increases the cost and complexity of the system and is thus undesirable. Opening the valve allows the pump to pressurize the fuel at the nozzle 38 so that fueling valve 34 opens and fuel flows when the customer manually operates lever 36. The vacuum valve 35 on each of the other nozzles that are not in use remain closed to prevent discharge of vapors recovered during fueling and drawing in of air.

Fuel flowing through the respective meter M causes signal pulses to be sent to the digital processor 32. If pulses are received by the processor at decision step 130, the processor executes step 134 causing the speed control 50 to regulate the vacuum pump motor 49 at speeds that maintain a vapor volumetric flow rate (V) proportional to the fuel flow rate (L) measured by the flow meter M for the selected grade of fuel to collect only the vapors displaced from the fuel tank. As previously discussed, the proportion is preferably approximately $V/L=1.18$, but may be varied according to a number of factors. The vapors are returned to the fuel storage tanks to replace the liquid fuel being withdrawn.

If pulses are not being received at decision step 132, indicating that fuel is not flowing, the processor executes step 136 and reads the position of switch S to determine if the lever 43 is down, indicating that the customer has probably replaced the nozzle on its cradle. If the lever is still up, the processor enters a loop in which it continues to look for either pulses from flow meter or the lever being down. If the lever is down, the processor executes termination step 138 in which the dispense cycle is terminated by turning off the fuel pump P and the motor 49 of vacuum pump 46 and by displaying the final sale.

Once fuel begins flowing, the processor executes decision step 140, which is a loop that monitors the signal pulses from the fuel flow meter. If the pulses stop, the processor directs the speed controller 50 at step 142 to reduce the speed of the vacuum pump motor to 400 rpm to maintain a partial vacuum. The processor then returns to the loop formed by decision steps 132 and 136 to continually check whether fuel begins flowing again or if the nozzle lever 43 is lowered. If the nozzle lever is lowered, the processor exits the loop and terminates the dispense cycle by executing step 138. Otherwise, the processor repeats dispensing steps 134 and 140.

It will be appreciated that the vacuum pump means 46 and 49 can alternatively be a constant speed electric motor with a variable volume vacuum pump responding to the electrical signal from the digital processor. It will also be appreciated that a dedicated digital processor, or other electrical system can be used to control the volume through-put of the vacuum pump in response to the measured liquid flow rate.

Although preferred embodiments of the invention have been described in detail, it is to be understood that various changes, substitutions and alterations can be made therein without departing from the spirit and scope of the invention as defined by the appended claims.

What is claimed is:

1. In a system for dispensing volatile liquids into a tank through a nozzle and having closely associated with the nozzle a vapor recovery intake, a method for operating a vacuum to assist in recovering flow vapors from the tank displaced by the liquid comprising the steps of:

operating a vacuum pump prior to commencement of dispensing to establish a prestart vacuum at the vapor intake;

turning on a fuel pump for pumping liquid from a storage tank to the nozzle in response to a demand for dispensing;

opening a control valve coupled between the fuel pump and the nozzle after the establishment of the prestart vacuum, the prestart vacuum enabling the vapor intake to recover an initial displacement vapor immediately upon commencement of a flow of liquid through the nozzle; and operating the vacuum pump, upon commencement of the flow of liquid through the nozzle, at a predetermined relationship with the flow of the liquid.

2. The method of claim 1 further including the step of operating the vacuum pump at a rate to reestablish the prestart vacuum at the vacuum intake once fuel flow ceases and before an indication that dispensing is no longer demanded.

3. The method of claim 2 further including the step of operating the vacuum at the predetermined relationship with the flow of the liquid if the flow of the liquid resumes after ceasing and before the indication that dispensing is no longer demanded.

4. The method of claim 1 wherein the step of operating the vacuum pump prior to commencement of dispensing includes the step of starting the vacuum pump after a customer demands dispensing.

5. The method of claim 1 wherein the step of operating the vacuum pump prior to commencement of dispensing includes the step of establishing the prestart vacuum within a period of time for resetting a transaction display.

6. The method of claim 5 wherein the step of establishing the prestart vacuum includes initially jolting an electric motor driving the vacuum pump with high power to start the vacuum pump and then regulating the speed of the electric pump to establish a predetermined level for the prestart vacuum.

7. The method of claim 1 wherein the vacuum intake includes a valve opened by a vacuum having a predetermined vacuum level, and wherein the prestart vacuum has a level less than the predetermined vacuum level.

8. The method of claim 1 wherein the step of opening the control valve is in response to an end of reset cycle for a transaction display.

9. The method of claim 1 wherein the step of opening the control valve is in response to an elapsing of a predetermined time period.

10. A system for dispensing volatile liquids, such as hydrocarbon fluids for a vehicle and for collecting vapors of the volatile liquids during dispensing to reduce atmospheric pollution comprising:

a dispensing nozzle having a customer-operated dispensing valve for customer control of a flow of liquid through the nozzle and into a vehicle tank; the nozzle including a vapor inlet for collecting vapors during dispensing of volatile fluids and a vapor valve;

means available to a customer for indicating demand for dispensing;

a fueling line for delivering to the dispensing nozzle a flow of liquid from a tank storing a supply of volatile fluid and a fuel pump for pumping fluid to the nozzle through the fueling line;

a vapor recovery line coupled through the vapor valve to the vapor inlet;

a vacuum pump driven by a variable speed motor and coupled to the vapor recovery line for creating a vacuum in the vapor recovery line;

means for causing the vacuum pump to create a prestart vacuum at the vacuum valve prior to commencement of a flow of liquid through the nozzle, the prestart vacuum enabling recovery through the vapor intake of an initial flow of vapor immediately after commencement of a flow of liquid through the nozzle;

a control valve between the fuel pump and the flow meter for opening the fueling line to a flow of liquid from the tank to the nozzle after a partial vacuum is established;

means responsive to an indication of a flow of liquid through the nozzle for causing the vacuum pump to operate at a rate having a predetermined relationship to the flow rate of the liquid in order to recover through the vapor intake an expected flow of vapor from the filling neck.

11. The system of claim 10 further including means for displaying transaction information to a customer, wherein the means for displaying resets transaction information during creation of a partial vacuum.

12. The system of claim 10 wherein the vacuum valve is opened when a predetermined level of vacuum is reached in the vapor recovery line; and wherein the prestart vacuum has a level less than the predetermined level and great enough to enable recovery of an initial flow of vapor immediately after commencement of liquid flowing through the nozzle.

13. A system for dispensing fuel into tanks of automobiles having a capability for recovering fuel vapors displaced from a tank, the system comprising:

a nozzle through which fuel is dispensed into a vehicle's tank, the nozzle having a manually controlled valve for controlling the flow of fuel through the nozzle;

a pump for pumping fuel under pressure to the nozzle through a fuel line;

a control valve in the fuel line for coupling a fuel under pressure in the pump to the nozzle;

a meter coupled to the fuel line for measuring the flow rate of fuel in the fuel line going to the nozzle;

a vapor intake disposed in close proximity to the nozzle for recovering vapors displaced from the fuel tank;

a vapor recovery line coupled to the vapor intake through a vacuum valve;

a vacuum pump coupled to the vapor recovery line for creating a vacuum in the line to draw in a flow of vapor from the tank;

means for creating by running the vacuum pump prior to commencement of fuel flowing through the nozzle a prestart vacuum at the vacuum valve for assisting in capturing an initial flow of vapor immediately following commencement of a flow of fuel;

means for opening the control valve after the prestart vacuum is established; and means for operating the vacuum pump upon indication of fuel flow from the meter at a rate having a predetermined relationship with the flow rate indicated by the meter.

14. The system of claim 13 where the vacuum valve is opened by suction applied by a predetermined vacuum level; and wherein the prestart vacuum level is less than the predetermined vacuum level but high enough to enable development of additional vacuum to quickly open the vacuum valve and draw in an initial flow of vapor immediately after commencement of the flow of fuel.

15. The system of claim 13 further including an electronic means for displaying to the customer transaction information, the means for displaying resetting in response to a demand for dispensing from a customer; wherein the means for creating a prestart vacuum creates the vacuum by a time at which the resetting of the means for displaying finishes, and wherein the means for opening the control valve opens the control valve after the resetting finishes.

16. The system of claim 13 wherein the means for creating the prestart vacuum, means for opening the control valve and the means for operating the vacuum are comprised of a specially programmed processor.

17. The system of claim 16 further comprising an electronic display of transaction totals, wherein the processor writes to the display and performs a resetting cycle during which the display is tested to demonstrate to a customer that it properly indicates totals; and wherein the processor begins operation of the vacuum pump during a resetting cycle and the prestart vacuum is established prior to completion of the resetting cycle.

18. The system of claim 13 further including a fuel storage tank.

19. A system for dispensing fuel into tanks of automobiles having a capability for recovering fuel vapors displaced from a tank, the system comprising:

a nozzle through which fuel is dispensed into a vehicle's tank, the nozzle having a manually controlled valve for controlling the flow of fuel through the nozzle;

a fuel pump for pumping fuel under pressure to the nozzle through a fuel line;

a control valve in the fuel line for coupling a fuel under pressure in the pump to the nozzle;

a meter coupled to the fuel line for measuring the flow rate of fuel in the fuel line going to the nozzle;

a vapor intake disposed in close proximity to the nozzle for recovering vapors displaced from the fuel tank;

a vapor recovery line coupled to the vapor intake through a vacuum valve;

a vacuum pump coupled to the vapor recovery line for creating a vacuum in the line to draw in a flow of vapor from the tank;

a processor coupled for controlling the fuel pump, control valve and vacuum pump, the processor specially programmed for operating the vacuum pump prior to commencement of fuel flowing through the nozzle to create a prestart vacuum at the vacuum valve for assisting in capturing an initial flow of vapor immediately following commencement of a flow of fuel, opening the control valve after the prestart vacuum is established, and operating the vacuum pump upon indication of fuel flow from the meter at a rate having a predetermined relationship with the flow rate indicated by the meter.

20. The system of claim 19 wherein the processor is further programmed to execute a reset cycle after an indication is received that a customer desires dispensing, and to start the vacuum pump during the reset cycle and operate the vacuum pump in a manner to achieve the prestart vacuum prior to the end of the reset cycle.

* * * * *